US011532431B2

(12) United States Patent
Salunkhe et al.

(10) Patent No.: US 11,532,431 B2
(45) Date of Patent: Dec. 20, 2022

(54) FUSE BLOCK MOUNTING BRACKET FOR TRANSFORMER

(71) Applicant: Johnson Controls Technology Company, Auburn Hills, MI (US)

(72) Inventors: Ravindra B. Salunkhe, Satara (IN); Bhushan D. Vichare, Pune (IN); Vishal S. Jagtap, Dombivli (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 82 days.

(21) Appl. No.: 16/796,737

(22) Filed: Feb. 20, 2020

(65) Prior Publication Data

US 2021/0265106 A1 Aug. 26, 2021

(51) Int. Cl.

| | |
|---|---|
| ***H01F 27/06*** | (2006.01) |
| ***H01F 27/40*** | (2006.01) |
| ***F24F 11/88*** | (2018.01) |

(52) U.S. Cl.

CPC ..... *H01F 27/402* (2013.01); *F24F 11/88* (2018.01); *H01F 27/06* (2013.01)

(58) Field of Classification Search

CPC .. H01F 27/402; H01F 27/06; H01F 2027/065; F24F 11/88

See application file for complete search history.

(56) References Cited

U.S. PATENT DOCUMENTS

| | | | | |
|---|---|---|---|---|
| 3,479,563 | A * | 11/1969 | Roy | H01F 27/402 361/104 |
| 4,901,182 | A * | 2/1990 | Book | H01F 27/10 361/38 |
| 5,116,246 | A * | 5/1992 | Perry | H01R 9/245 337/209 |
| 6,304,429 | B1 | 10/2001 | Locht et al. | |
| 7,601,030 | B2 * | 10/2009 | Patel | H01F 27/29 439/620.3 |
| 2008/0197961 | A1 | 8/2008 | Patel | |

FOREIGN PATENT DOCUMENTS

| | | | |
|---|---|---|---|
| JP | H0810171 | Y2 * | 3/1996 |
| KR | 20030042940 | A * | 6/2003 |
| KR | 200341422 | Y1 | 2/2004 |
| KR | 20190001716 | U | 7/2019 |

* cited by examiner

*Primary Examiner* — Tuyen T Nguyen

(74) *Attorney, Agent, or Firm* — Fletcher Yoder, P.C.

(57) ABSTRACT

A heating, ventilation, and/or air conditioning (HVAC) system includes a transformer mounted to a control panel and having a first mounting flange and a fuse block mounting bracket extending about the transformer. The fuse block mounting bracket includes a second mounting flange engaged with the first mounting flange. The HVAC system also includes a fuse block mounted to the fuse block mounting bracket.

24 Claims, 9 Drawing Sheets

FUSE BLOCK MOUNTING BRACKET FOR TRANSFORMER

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

HVAC systems are utilized in residential, commercial, and industrial environments to control environmental properties, such as temperature and humidity, for occupants of the respective environments. An HVAC system may control the environmental properties through control of an air flow delivered to the environment. For example, the HVAC system may circulate a refrigerant and place the refrigerant in a heat exchange relationship with a supply air flow to condition the supply air flow before it is discharged to the conditioned environment. The HVAC system may include a control system configured to control the operation of various components of the HVAC system for conditioning the supply air flow. The control system may include a control panel onto which various electrical equipment, such as a transformer, may be mounted. However, it may be costly to manufacture the transformer for implementation with the control panel and/or the transformer may occupy an excessive equipment footprint on the control panel.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a transformer mounted to a control panel and having a first mounting flange and a fuse block mounting bracket extending about the transformer. The fuse block mounting bracket includes a second mounting flange engaged with the first mounting flange. The HVAC system also includes a fuse block mounted to the fuse block mounting bracket.

In another embodiment, a fuse block mounting bracket for a heating, ventilation, and/or air conditioning (HVAC) system includes a mounting flange configured to engage with a transformer mounting flange, a support flange extending transversely from the mounting flange, and a mounting panel extending transversely from the support flange. The mounting panel is configured to couple to and support a fuse block of the HVAC system.

In another embodiment, a transformer assembly for a heating, ventilation, and/or air conditioning (HVAC) system includes a transformer having a transformer mounting flange with a first mounting feature and a fuse block mounting bracket having a mounting panel, a support flange extending transversely from the mounting panel, and a bracket mounting flange extending transversely from the support flange. The bracket mounting flange includes a second mounting feature configured to align with the first mounting feature of the transformer assembly in an assembled configuration of the transformer assembly. The transformer assembly also includes a fuse block configured to mount to the mounting panel in the assembled configuration.

DRAWINGS

Various aspects of this disclosure may be better understood upon reading the following detailed description and upon reference to the drawings in which.

DETAILED DESCRIPTION

Figure 1:
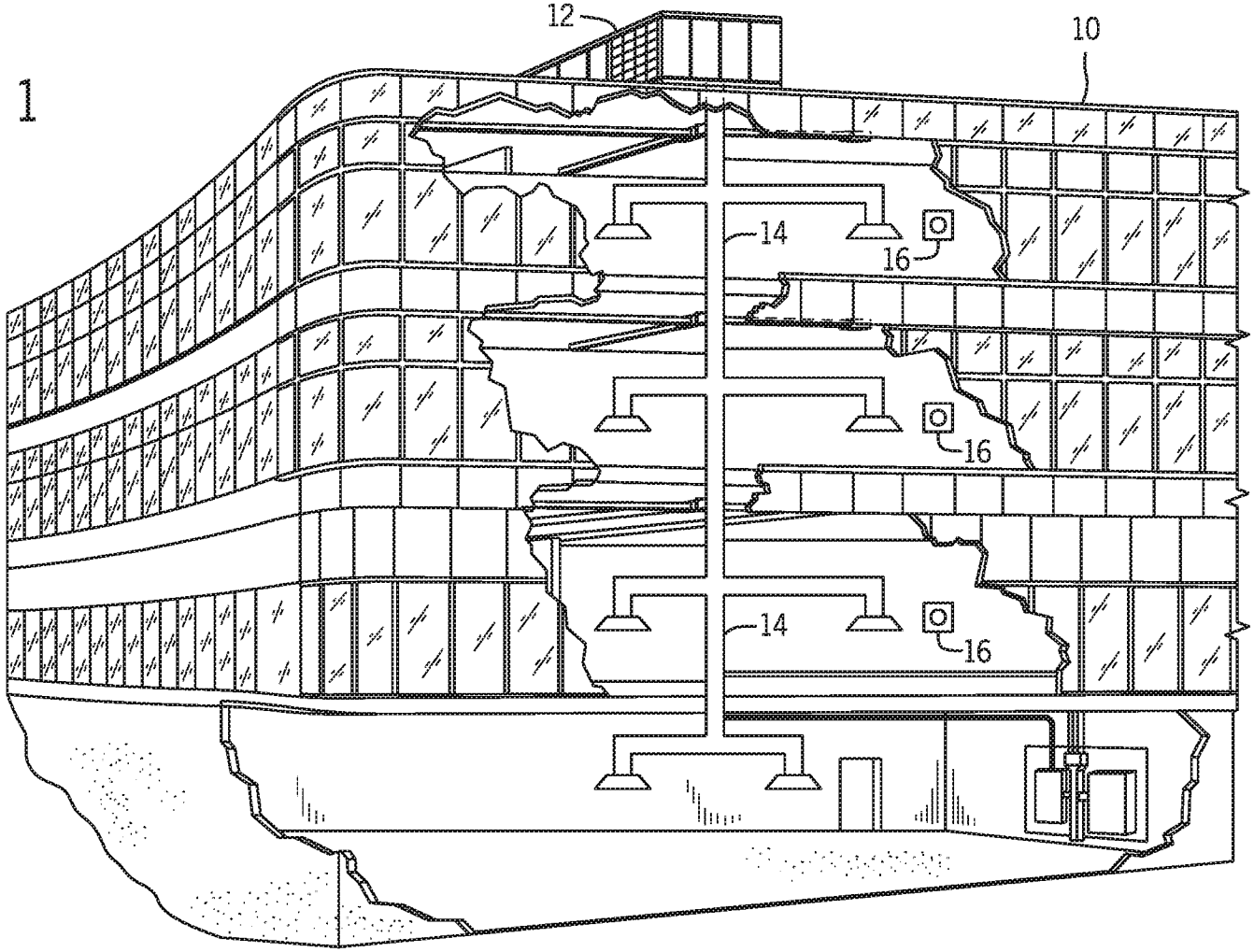
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system that includes a control panel. The control panel may be used to operate the HVAC system to condition an air flow, such as by regulating operation of various components of the HVAC system. Various equipment, such as electrical equipment, may be configured to mount onto the control panel. For example, the control panel may include a transformer configured to receive an electrical current and convert a voltage of the received electrical current into a voltage that is suitable for providing power to other equipment of the control panel.

The transformer may be electrically coupled to one or more fuses configured to block excessive electrical current from flowing to or from the transformer. As an example, a primary side of the transformer is configured to receive electrical current from a power source, and the fuse(s) may be electrically connected to the primary side of the transformer between the power source and the transformer. When the fuse(s) receive excessive electrical current from the power source, the fuse(s) may electrically decouple the transformer from the power source, thereby blocking the flow of the electrical current to the transformer. In certain conventional approaches, the fuse(s) and the transformer are separately mounted on the control panel. That is, the transformer may be mounted at a first position on the control panel and the fuse(s) may be mounted at a second position that is different than the first position on the control panel. In this manner, the fuse(s) and the transformer occupy different spaces on the control panel and may reduce an amount of available space for mounting other equipment onto the control panel. As a result, a larger control panel may be used to accommodate the other equipment, thereby increasing a cost of manufacturing the HVAC system. Additionally or alternatively, certain embodiments of transformers may be integrally formed with corresponding fuses. However, such embodiments may be costlier than transformers and fuses that are separately manufactured. Additionally, it may be difficult to modify such transformer embodiments, such as by removing and/or replacing the fuses or the transformer during maintenance. As such, it may not be desirable to implement transformers that are integrally formed with fuses.

Thus, it is now recognized that mounting fuses directly onto the transformer reduces an equipment footprint occupied by the transformer and the fuses on the control panel. That is, the fuses do not mount to a space on the control panel separate from the space where the transformer is mounted. In this manner, coupling the fuses onto the transformer may increase an available space for mounting and/or installing other equipment onto the control panel. Accordingly, embodiments of the present disclosure are directed to a bracket configured to couple a transformer to a fuse block configured to receive fuses that may be electrically connected to the transformer. The bracket may include mounting flanges configured to couple to the transformer, and the bracket may include a mounting panel to which the fuse block may be mounted. The bracket with the fuse block mounted thereto may be mounted to the control panel with the transformer at a common mounting location.

In some embodiments, the bracket may be removably coupled to the transformer, such as via first fasteners, and the fuse block may be removably coupled to the fuse block, such as via second fasteners. In this manner, the assembly of the transformer, the bracket, and the fuse block may be easily modifiable, such as to remove and replace a fuse, the fuse block, and so forth. The bracket may also generally conform with or capture a geometry of the transformer such that the bracket does not substantially extend beyond a profile of the transformer. In this manner, the amount of space occupied by the bracket on the control panel is limited, thereby limiting the equipment footprint of the transformer and the fuses and reducing a cost associated with manufacturing the control panel.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
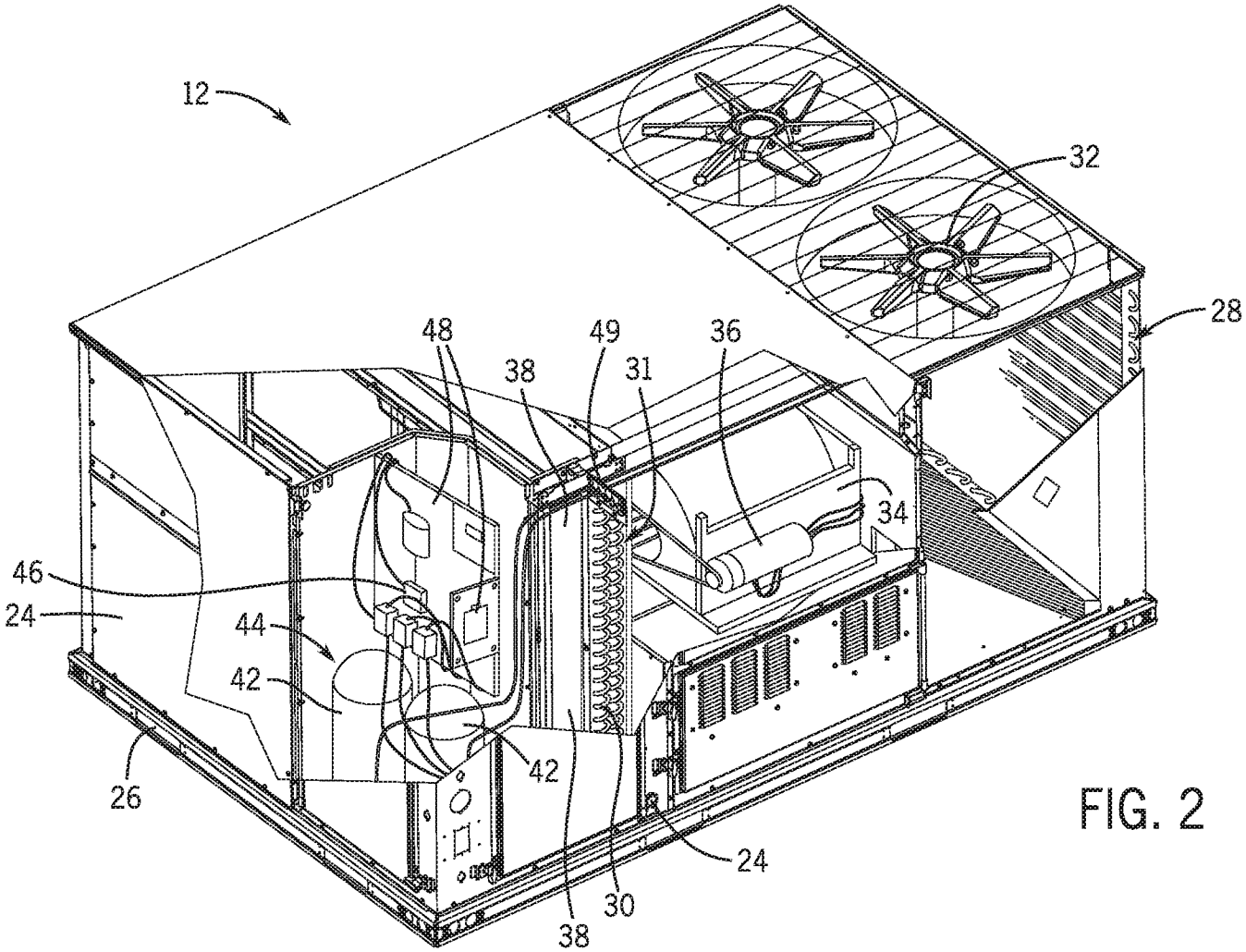
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be noted, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
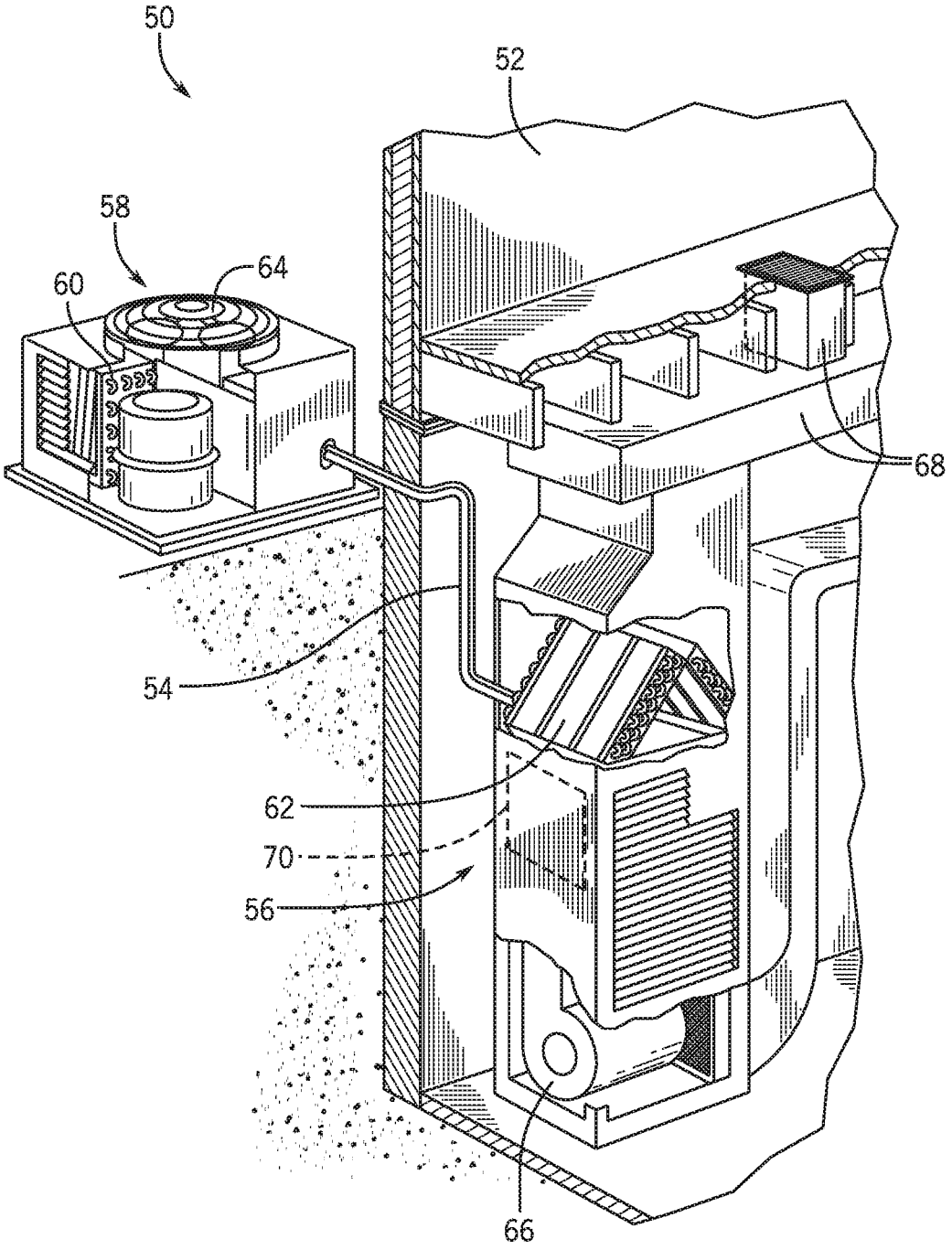
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
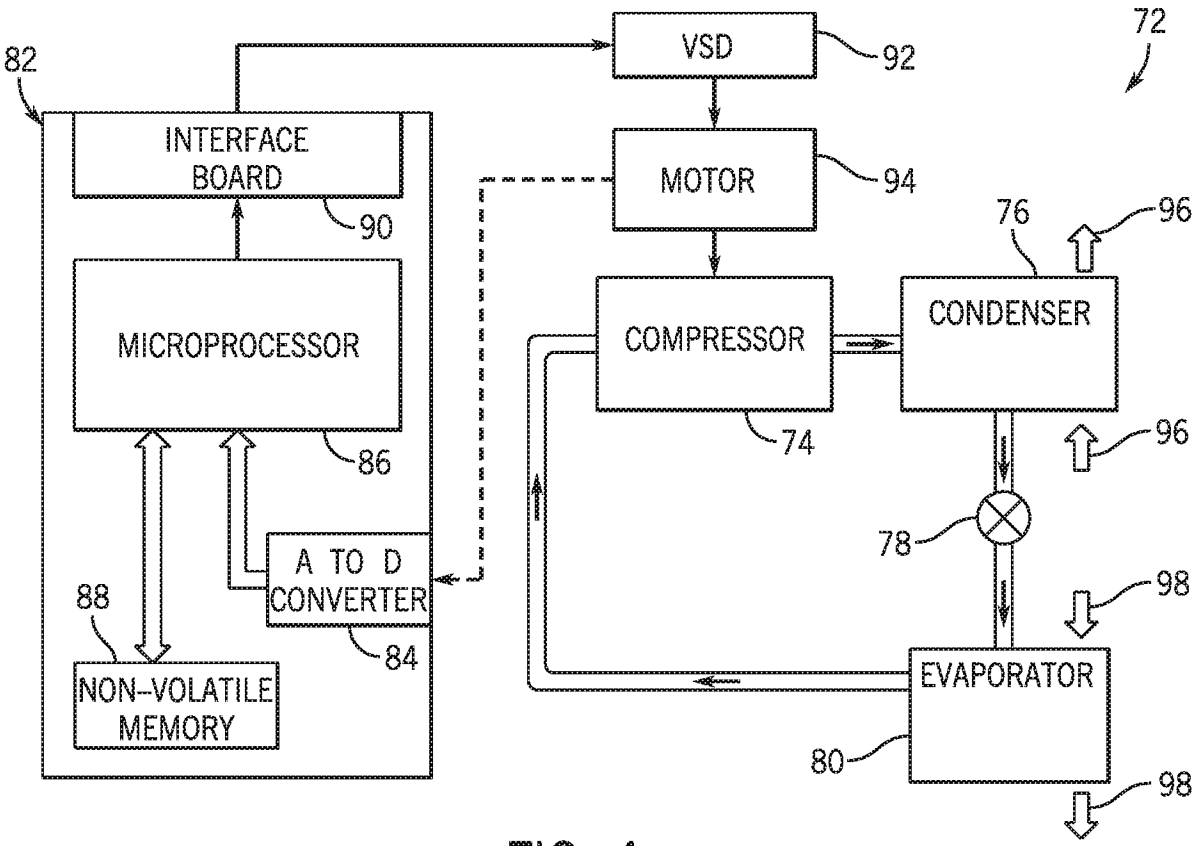
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be noted that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
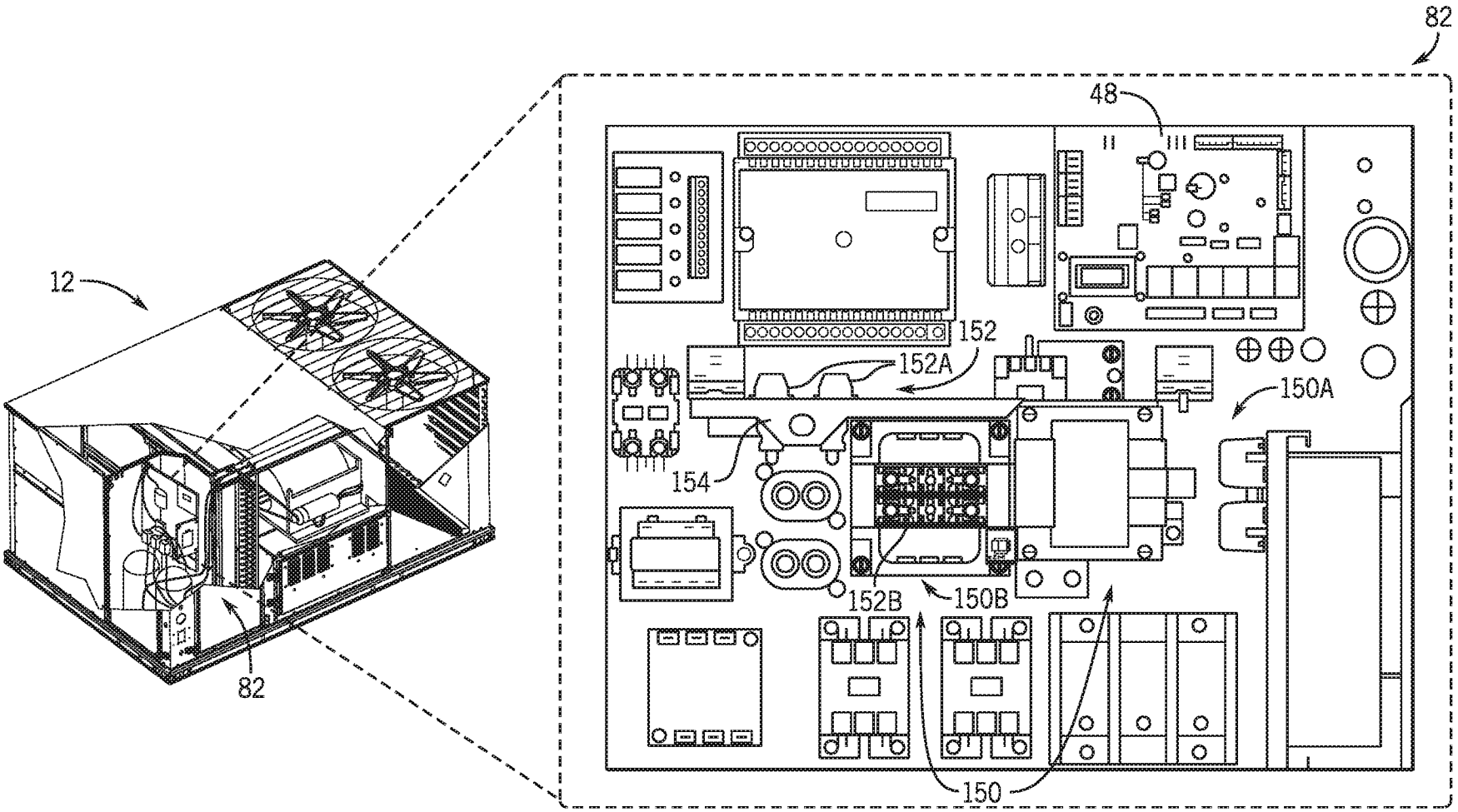
FIG. 5 is an expanded view of an embodiment of a control panel that may be implemented with the packaged HVAC unit of FIG. 2, in accordance with an aspect of the present disclosure.

With this in mind, FIG. 5 is an expanded view of an embodiment of the control panel 82, which is shown as implemented in the HVAC unit 12 of FIGS. 1 and 2 in the illustrated embodiment. However, the control panel 82 may also be implemented in the residential heating and cooling system of FIG. 3 or in any other HVAC system. The control panel 82 may include various electrical equipment mounted onto the control panel 82 to control operation of the HVAC unit 12 to condition an air flow for supply to a structure, such as the building 10, serviced by the HVAC unit 12. For example, the control board 48 may be mounted to the control panel 82 and may be configured to output control signals to control various components of the vapor compression system 72 of the HVAC unit 12, such as the compressors 42 in order to control pressurization of a refrigerant.

Additionally, transformer assemblies 150 may be mounted to the control panel 82. The transformer assemblies 150 may convert electrical power to be used by other electrical components, such as the control board 48, for operation. For instance, each transformer assembly 150 may receive an electrical current from a power supply, such as a utility grid, and may convert a voltage of the electrical current into a suitable voltage to be used by the electrical components. Fuses 152 may also be implemented to block the transformer assemblies 150 from receiving excessive electrical current, which may result from an electrical surge and which may impact an operation of the transformer assemblies 150. A first transformer assembly 150A may be electrically coupled to first fuses 152A, which are mounted to the control panel 82 separately from the first transformer assembly 150A. As a result, the first transformer assembly 150A may mount to the control panel 82 at a first location, and the first fuses 152A may mount to the control panel 82 at a second, different location. For instance, the first fuses 152A may be coupled and/or mounted to a shelf 154 of the control panel 82, and electrical connections, such as a wires, may be used to electrically connect the first transformer assembly 150A with the first fuses 152A. Further, a second transformer assembly 150B may include second fuses 152B, which are a part of the second transformer assembly 150B. As such, the second transformer assembly 150B and the second fuses 152B may be commonly or jointly mounted to the control panel 82, such that the second transformer assembly 150B and the second fuses 152B do not occupy separate mounting locations. For this reason, the second transformer assembly 150B and the second fuses 152B occupy a smaller equipment footprint relative to that occupied by the first transformer assembly 150A and the first fuses 152A.

Figure 6:
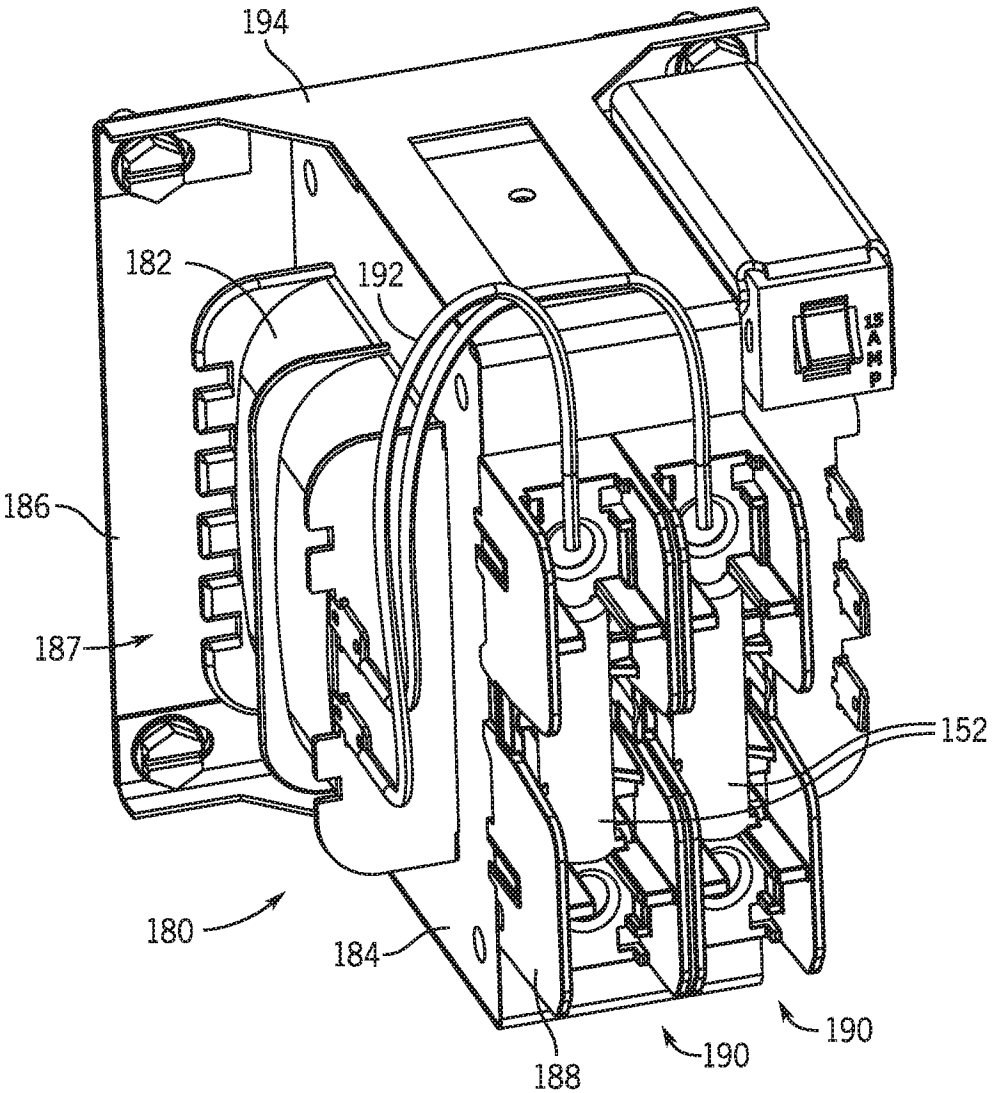
FIG. 6 is a perspective view of an embodiment of a transformer assembly that may be implemented with a control panel of an HVAC system, in accordance with an aspect of the present disclosure.

FIG. 6 is a perspective view of an embodiment of the transformer assembly 150, such as the second transformer assembly 150B, in an assembled configuration. The transformer assembly 150 may include a transformer 180 having a core 182, which may be configured to transform the voltage of a received electrical current. The core 182 may be partially disposed within an enclosure 184 of the transformer assembly 150. The transformer assembly 150 may also include a transformer mounting flange 186, which may be used to mount and secure the transformer 180 to the control panel 82. The transformer mounting flange 186 may be integrally formed with, and/or coupled to the enclosure 184. As will be described in greater detail below, the transformer mounting flange 186 may include features for coupling the transformer mounting flange 186 to the control panel 82.

Additionally, the transformer assembly 150 includes the fuses 152, such as the second fuses 152B, that are electrically coupled to the core 182. The fuses 152 may be coupled to a primary side 187 of the core 182. The primary side 187 may be configured to receive electrical power from a power supply, and the fuses 152 may block the core 182 from receiving an excessive electrical current and/or voltage from the power supply. In additional or alternative embodiments, the fuses 152 may be electrically coupled to a different part of the core 182, such as a secondary side configured to output electrical power, and the fuses 152 may block the core 182 from outputting an excessive electrical current and/or voltage.

In the illustrated embodiment, the fuses 152 are coupled to a fuse block 188. For instance, the fuse block 188 may include slots 190 in which the fuses 152 may be respectively inserted and secured. The illustrated fuse block 188 includes two slots 190 that may each receive one of the fuses 152, but in additional or alternative embodiments, the fuse block 188 may include any suitable number of slots 190 to receive a corresponding number of fuses 152. Electrical connections 192, such as a fuse link, a wire, a cable, and so forth, may be used for electrically coupling the fuses 152 to the core 182. The electrical connections 192 may extend from within the slots 190 to various portions of the core 182.

In some embodiments, the fuse block 188 may not be integrally formed with or readily coupled to the transformer 180. That is, for example, the fuse block 188 and the transformer 180 may be separately manufactured and/or purchased and therefore, the fuse block 188 is not attached to the transformer 180. For this reason, the transformer assembly 150 may include a fuse block mounting bracket 194 configured to couple the fuse block 188 onto the transformer 180. In the assembled configuration, the fuse block mounting bracket 194 may be configured to extend about and/or over the transformer 180. In particular, the fuse block mounting bracket 194 may be shaped such that the fuse block mounting bracket 194 extends over the transformer 180 to capture a profile or shape of the transformer 180. By way of example, the fuse block mounting bracket 194 may abut the enclosure 184 and the transformer mounting flange 186 when assembled with the transformer 180 in an installed configuration. In other words, a geometry of the fuse block mounting bracket 194 may be selected to correspond with a geometry of the transformer 180 in an installed configuration of the transformer assembly 150. Thus, the fuse block mounting bracket 194 does not substantially extend beyond a boundary of the transformer 180 and therefore does not substantially increase an equipment footprint of the transformer 180, such as when mounted to the control panel 82. For instance, the fuse block mounting bracket 194 does not increase or substantially increase a space occupied by the transformer mounting flange 186 and by the enclosure 184. Further, as described further below, the geometry of the fuse block mounting bracket 194 may restrict relative movement between the fuse block mounting bracket 194 and the transformer 180, thereby improving securement of the fuse block 188 to the transformer 180.

Figure 7:
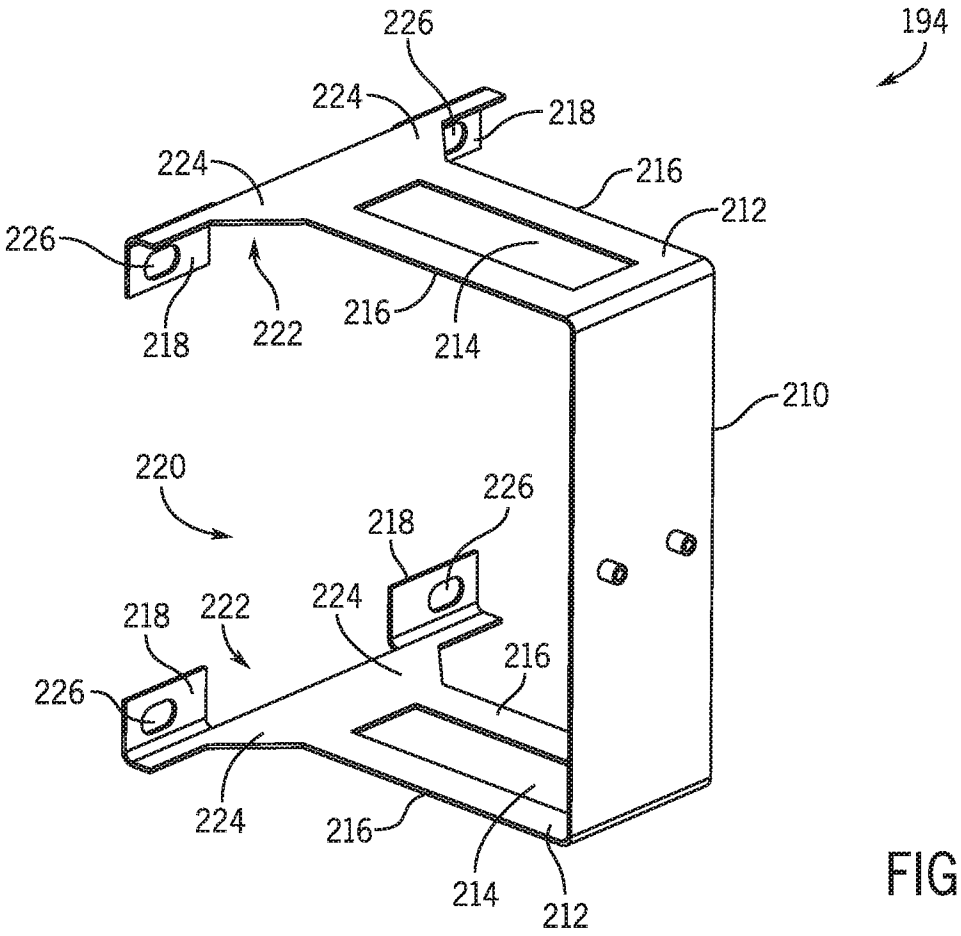
FIG. 7 is a perspective view of an embodiment of a fuse block mounting bracket that may be used in a transformer assembly, in accordance with an aspect of the present disclosure.

FIG. 7 is a perspective view of an embodiment of the fuse block mounting bracket 194, which may be implemented in the transformer assembly 150. The fuse block mounting bracket 194 may include a generally C-shaped configuration configured to receive and capture a profile of the transformer 180. For example, the fuse block mounting bracket 194 may include a mounting panel 210 to which the fuse block 188 may be mounted. Thus, in the assembled configuration, the mounting panel 210 may support the fuse block 188. Furthermore, the fuse block mounting bracket 194 may include support flanges 212 extending transversely from the mounting panel 210, such as in a substantially perpendicular direction relative to the mounting panel 210. In the illustrated embodiment, the support flanges 212 extend from opposite ends of the mounting panel 210. However, it should be noted that the support flanges 212 and the mounting panel 210 may have other arrangements or configurations, such as based on a geometry or profile of the transformer 180.

Furthermore, each support flange 212 may include a cutout 214. The cutouts 214 may each be an internal cutout formed between and defined by respective edges 216 of the support flanges 212. The illustrated cutouts 214 have a rectangular shape, but additional or alternative embodiments of the cutouts 214 may have any suitable shape, such as a circular shape, a triangular shape, and so forth. The cutouts 214 may enable heat dissipation from the transformer 180 in the assembled configuration of the transformer assembly 150 and during operation of the transformer 180. For instance, the cutouts 214 may increase an amount of surface area of the transformer 180 that is exposed to an ambient environment or to surrounding air to enable greater heat transfer from the transformer 180 to the ambient environment. Thus, the cutouts 214 enable increased cooling of the transformer 180 thereby improving performance of the transformer 180.

Additionally, the fuse block mounting bracket 194 may include bracket mounting flanges 218 extending transversely from the support flanges 212, such as substantially perpendicularly relative to the support flanges 212. Two bracket mounting flanges 218 extend from each support flange 212 in the illustrated embodiment, and the bracket mounting flanges 218 of the respective support flanges 212 may extend toward one another. In this manner, the mounting panel 210, the support flanges 212, and the bracket mounting flanges 218 form a space or channel 220 configured to receive the transformer 180 in the assembled configuration. However, in additional or alternative embodiments, the fuse block mounting bracket 194 may include any suitable number of bracket mounting flanges 218 extending from the support flanges 212 in any suitable configuration.

A gap 222 may be formed between the two bracket mounting flanges 218 of each support flange 212 to accommodate the placement of the enclosure 184 within the space 220 for coupling the fuse block mounting bracket 194 to the transformer 180. Further still, the fuse block mounting bracket 194 may include chamfers 224 extending between the support flanges 212 and corresponding bracket mounting flanges 218. That is, the chamfers 224 may extend diagonally from the support flanges 212 to the bracket mounting flanges 218 to increase an amount of contact between the bracket mounting flanges 218 and the support flanges 212, thereby increasing a structural integrity of the fuse block mounting bracket 194. Each bracket mounting flange 218 may also have a first mounting feature 226 configured to enable coupling between the fuse block mounting bracket 194 and the transformer 180. For example, the first mounting features 226 may include mounting holes, slots, or receptacles configured to receive a fastener that removably couples the fuse block mounting bracket 194 to the transformer mounting flange 186 in the assembled configuration.

In certain implementations, the fuse block mounting bracket 194 may be formed from a single component or piece of material. For example, the fuse block mounting bracket 194 may be made from a single piece of sheet metal, such as steel, aluminum, and the like, such as by cutting, stamping, bending, forming, and so forth. In additional or alternative embodiments, the fuse block mounting bracket 194 may be assembled from different or separate components. For instance, the mounting panel 210, the support flanges 212, and/or the bracket mounting flanges 218 may be separately manufactured and may be coupled to one another to form the transformer assembly 150.

Figure 8:
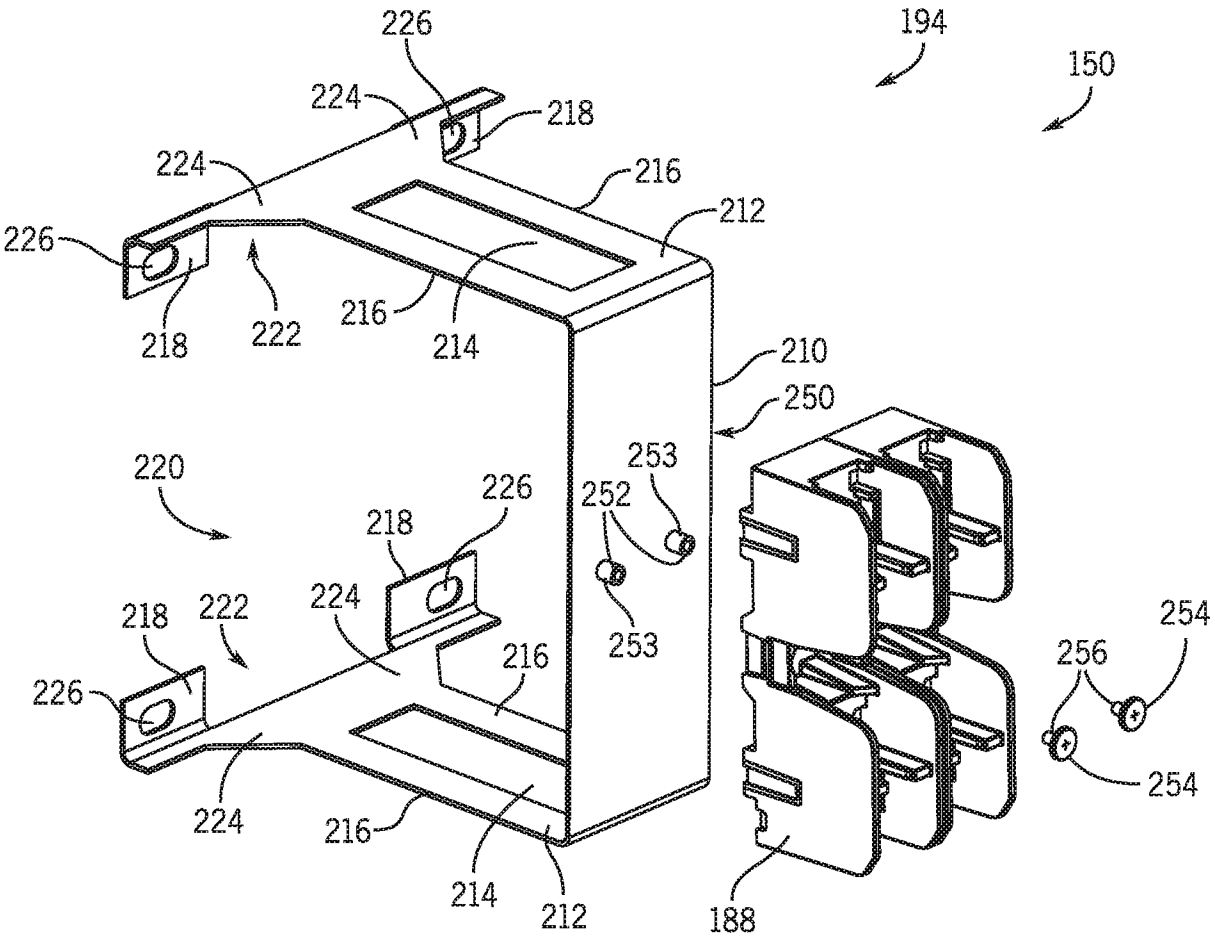
FIG. 8 is a perspective exploded view of an embodiment of a fuse block mounting bracket and a fuse block, in accordance with an aspect of the present disclosure.

FIG. 8 is an exploded perspective view of the fuse block mounting bracket 194 and the fuse block 188 of the transformer assembly 150. As illustrated in FIG. 8, the fuse block 188 may be configured to couple to a mounting surface 250 of the mounting panel 210 of the fuse block mounting bracket 194. By way of example, the mounting panel 210 may include mounting points or receptacles 252 that are each configured to receive a respective first fastener 254. The fuse block 188 may have corresponding apertures or holes configured to align with the receptacles 252 such that the respective first fasteners 254 may be inserted through the holes and into aligned receptacles to couple the fuse block 188 to the mounting panel 210. Although the illustrated fuse block mounting bracket 194 includes two receptacles 252 approximately centered along a height of the mounting surface 250, additional or alternative embodiments of the fuse block mounting bracket 194 may include any suitable number of receptacles 252 positioned at any suitable location on the mounting surface 250.

In certain embodiments, the receptacles 252 may be a part of punched holes that extend away or outwardly from the mounting surface 250. More specifically, the receptacles 252 may be defined by generally tubular extensions 253 formed via a punching process, such that the tubular extensions 253 extend from the mounting panel 210 in a direction opposite the space 220. In this way, the receptacles 252 do not extend into the space 220 and therefore do not interfere with or contact the transformer 180 in the assembled configuration, thereby enabling the fuse block mounting bracket 194 and the transformer 180 to closely conform to one another and limit or reduce the space occupied by the transformer assembly 150.

Threads may be formed in an inner diameter or surface of the tubular extensions 253 to enable threaded engagement between the first fasteners 254 and the receptacles 252 in order to secure the first fasteners 254 within the receptacles 252. Additionally, the fuse block 188 may have recesses in which the receptacles 252 may be inserted in the assembled configuration. For example, the recesses may capture a shape of the tubular extensions 253 in the assembled configuration, thereby restricting movement between the fuse block 188 and the fuse block mounting bracket 194. In some implementations, the tubular extensions 253 may extend to offset the fuse block 188 from the mounting panel 210 of the fuse block mounting bracket 194 in the assembled configuration. That is, in the assembled configuration, the tubular extensions 253 may abut the fuse block mounting bracket 194 and may position the fuse block 188 at an offset distance from the mounting panel 210. Thus, a space may be formed between the fuse block 188 and the mounting panel 210. The space may enable greater cooling of the transformer 180. For instance, the space may expose a greater amount of surface area of the mounting panel 210 to the ambient environment, thereby increasing heat transfer from the transformer 180 to the mounting panel 210 and to the ambient environment surrounding the control panel 82. Additionally or alternatively, the receptacles 252 may extend a suitable distance to accommodate a size of the first fasteners 254. That is, a length of the tubular extensions 253 may accommodate a length of a threaded portion 256 of the first fasteners 254 and avoid contact between the threaded portions 256 and the transformer 180 in the assembled configuration.

Figure 9:
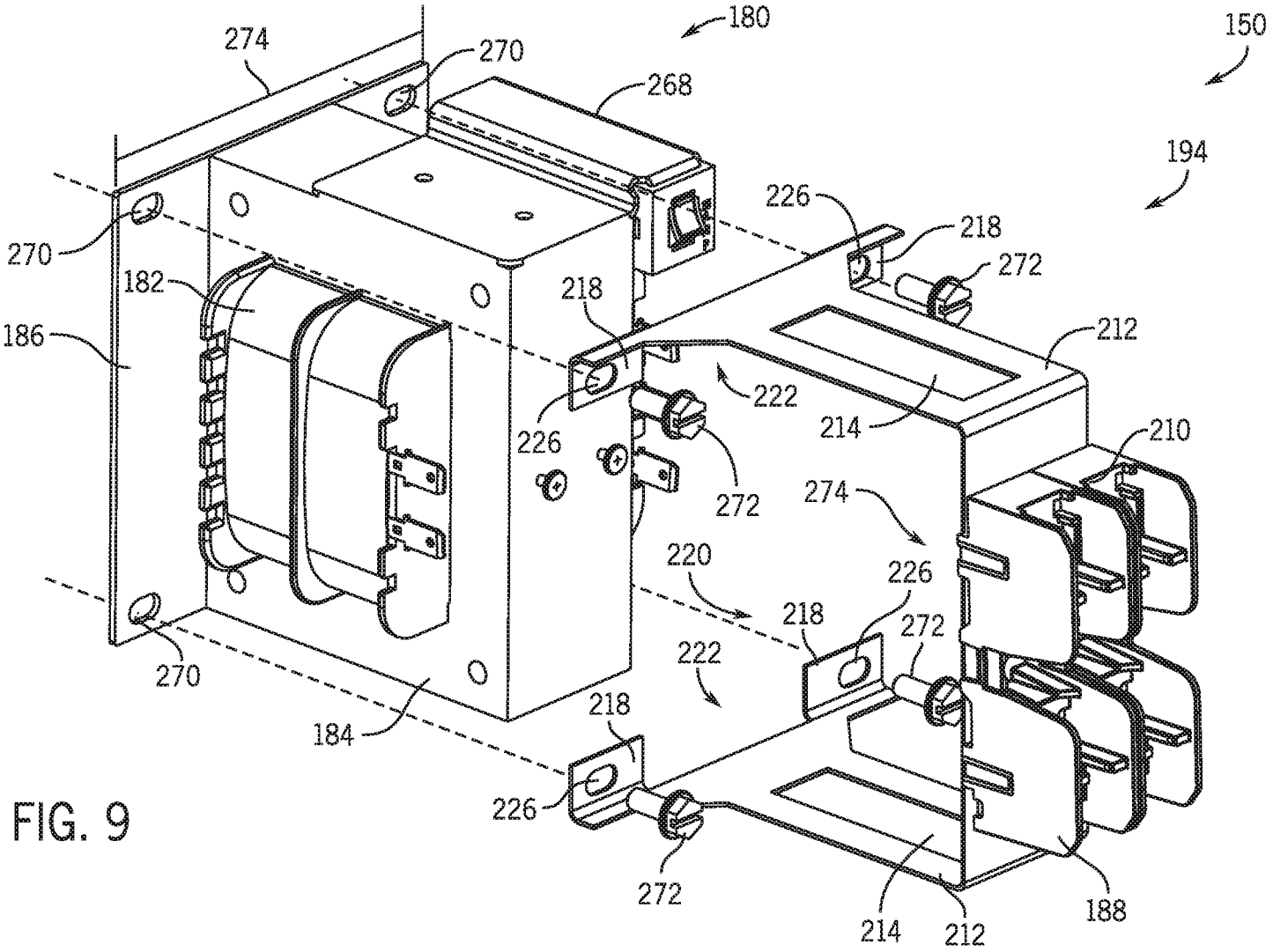
FIG. 9 is a perspective exploded view of an embodiment of a fuse block mounting bracket, a fuse block, and a transformer, in accordance with an aspect of the present disclosure.

FIG. 9 is a perspective exploded view of the transformer 180, the fuse block mounting bracket 194, and the fuse block 188 of the transformer assembly 150. To assemble the fuse block mounting bracket 194 to the transformer 180, the transformer 180 may be oriented such that the enclosure 184 is aligned with the gaps 222. As such, the enclosure 184 may be passed through the gaps 222 to enable positioning of the transformer 180 within the space 220 of the fuse block mounting bracket 194. In the illustrated assembled configuration, there may be a gap formed between the enclosure 184 and one or both of the support flanges 212. For this reason, an additional component, such as a portion or flange of a switch 268 may be inserted into the gap to couple with the transformer 180 and occupy the gap between the enclosure 184 and the support flange 212. In alternative embodiments, the mounting panel 210 and/or the support flanges 212 may abut the enclosure 184 so as to restrict movement between the transformer 180 and the fuse block mounting bracket 194.

As illustrated in FIG. 9, the transformer mounting flange 186 may include second mounting features 270. Each second mounting feature 270 may be configured to enable coupling or mounting of the transformer mounting flange 186 and the fuse block mounting bracket 194 to one another. As an example, the second mounting features 270 may include holes configured to align with the first mounting features 226 of the bracket mounting flanges 218 of the fuse block mounting bracket 194 in the assembled configuration. Furthermore, second fasteners 272 may be inserted through the aligned first and second mounting features 226, 270 to couple and/or secure the bracket mounting flanges 218 to the transformer mounting flange 186, thereby coupling the fuse block mounting bracket 194 to the transformer 180. For instance, the second fasteners 272 may compress the transformer mounting flange 186 and the bracket mounting flanges 218 together such that the bracket mounting flange 218 abuts the transformer mounting flange 186 in the assembled configuration. In certain embodiments, the second fasteners 272 may also be used to mount the transformer mounting flange 186 and the transformer 180 to the control panel 82. For instance, the second mounting features 270 may be configured to align with holes or receptacles of the control panel 82, and the second fasteners 272 may be inserted through the first mounting features 226, the second mounting features 270, and the holes of the control panel 82 to secure the transformer 180 and the fuse block mounting bracket 194 to the control panel 82 at a common mounting location. In other words, the second fasteners 272 may secure the fuse block mounting bracket 194 and the transformer 180 together and may also secure the transformer assembly 150 to the control panel 82. In this manner, additional or supplemental mounting features, such as holes, may not be included in the transformer 180 for securing the transformer 180 to the control panel 82.

In some embodiments, the first mounting features 226 may have an oblong geometry or shape. The oblong geometry may enable the first mounting features 226 to match and align with second mounting features 270 positioned in different locations, such as for different embodiments of transformers 180. By way of example, different embodiments of transformers 180 may have transformer mounting flanges 186 of different dimensions, such as widths 274. Accordingly, the second mounting features 270 may be formed along the widths 274 of the transformer mounting flanges 186 at different positions. However, the oblong geometry of the first mounting features 226 may enable alignment of the first mounting features 226 with the second mounting features 270 having varying locations to enable the second fasteners 272 to be inserted through the first and second mounting features 226, 270. As a result, existing transformers 180 may be retrofitted with the fuse block mounting bracket 194 without modifying the existing transformers 180, such as by forming new holes or mounting features in existing transformer mounting flanges 186. Accordingly, the first mounting features 226 of the fuse block mounting bracket 194 may align with the existing second mounting features 270 of the transformers 180, such that a single embodiment of the fuse block mounting bracket 194 may be configured to couple to multiple embodiments of the transformers 180.

Additionally, it should be noted that the first fasteners 254 and the second fasteners 272 may enable the fuse block 188, the fuse block mounting bracket 194, and the transformer 180 to be removably coupled from one another. In other words, the fuse block 188, the fuse block mounting bracket 194, and the transformer may be readily decoupled from one another by removing the first fasteners 254 and/or the second fasteners 272. In this manner, an individual component of the transformer assembly 150 may be easily and readily accessible, such as to modify or replace the component. For example, the transformer 180 may be decoupled from the fuse block mounting bracket 194 to change and/or modify the fuse block mounting bracket 194. Thus, embodiments of the fuse block mounting bracket 194 disclosed herein also facilitate improved modification, maintenance, replacement, or other manipulation of the transformer assembly 150.

The present disclosure may provide one or more technical effects useful in the manufacture of an HVAC system. For example, the HVAC system may have a control panel to which electrical components may be coupled. The electrical components may control operation of the HVAC system to condition an air flow. In some embodiments, a transformer assembly may be configured to couple to the control panel. The transformer assembly may include a transformer configured to receive an electrical current, modify a voltage of the electrical current, and direct the electrical current to power other electrical components of the control panel. The transformer assembly may also include a fuse block mounting bracket configured to mount a fuse block to the transformer, in which the fuse block is configured to accommodate fuses of the transformer assembly. The fuses may be electrically coupled to the transformer to block the transformer from receiving excessive electrical current, thereby protecting a structure of the transformer. As discussed in detail above, the fuse block mounting bracket is configured to closely conform to the transformer and enable mounting of the transformer assembly to the control panel at a common location. By closely and directly coupling the fuse block to the transformer via the fuse block mounting bracket, the fuse block mounting bracket may reduce an equipment footprint occupied by the transformer assembly. For instance, the transformer and the fuse block may share a common mounting location, rather than different mounting locations, on the control panel. As such, a smaller control panel may used to reduce a cost of manufacture of the HVAC system and/or additional features may be coupled to the control panel to increase functionality of the HVAC system. Furthermore, the fuse block mounting bracket may enable the transformer and the fuse block to be removably coupled to one another. Indeed, the transformer and the fuse block may be easily decoupled from one another, such as for accessing and/or modifying, maintaining, and/or replacing components of the transformer assembly.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A fuse block mounting bracket for a heating, ventilation, and/or air conditioning (HVAC) system, comprising:

a first mounting flange configured to engage with a transformer mounting flange;

a second mounting flange configured to engage with the transformer mounting flange;

a first support flange extending transversely from the first mounting flange;

a mounting panel extending transversely from the first support flange, wherein the mounting panel is configured to couple to and support a fuse block of the HVAC system; and a second support flange extending from the second mounting flange to the mounting panel, wherein the first support flange, the second support flange, and the mounting panel define a space configured to receive a transformer having the transformer mounting flange.

2. The fuse block mounting bracket of claim 1, wherein the mounting panel, the first support flange, the second support flange, the first mounting flange, and the second mounting flange integrally form a C-shaped configuration.

3. The fuse block mounting bracket of claim 1, wherein the mounting panel includes offsetting receptacles configured to receive fasteners to mount the fuse block to the mounting panel at an offset distance from the mounting panel.

4. The fuse block mounting bracket of claim 3, wherein the offsetting receptacles include threads to threadingly engage with the fasteners to mount the fuse block to the mounting panel.

5. The fuse block mounting bracket of claim 1, comprising a chamfer extending from the first mounting flange to the first support flange.

6. The fuse block mounting bracket of claim 1, wherein the first support flange includes an internal cutout defined by edges of the first support flange.

7. The fuse block mounting bracket of claim 1, wherein the first mounting flange has a first hole configured to align with a second hole of the transformer mounting flange and configured to receive a fastener to mount the fuse block mounting bracket to a control panel.

8. A transformer assembly for a heating, ventilation, and/or air conditioning (HVAC) system, comprising:

a transformer having a transformer mounting flange with a first mounting feature;

a fuse block mounting bracket having a mounting panel, a support flange extending transversely from the mounting panel, and a bracket mounting flange extending transversely from the support flange, wherein the bracket mounting flange includes a second mounting feature configured to align with the first mounting feature of the transformer mounting flange in an assembled configuration of the transformer assembly to mount the transformer and the fuse block mounting bracket at a common mounting location of the HVAC system via the first mounting feature and the second mounting feature; and a fuse block configured to mount to the mounting panel in the assembled configuration.

9. The transformer assembly of claim 8, wherein the support flange is a first support flange, the bracket mounting flange is a first bracket mounting flange, the fuse block mounting bracket includes a second support flange extending transversely from the mounting panel and a second bracket mounting flange extending transversely from the second support flange, and the first and second bracket mounting flanges extend from opposite sides of the mounting panel.

10. The transformer assembly of claim 9, wherein the first bracket mounting flange and the second bracket mounting flange extend toward one another.

11. The transformer assembly of claim 8, wherein the bracket mounting flange is a first bracket mounting flange and the fuse block mounting bracket includes a second bracket mounting flange extending transversely from the support flange.

12. The transformer assembly of claim 11, wherein the first bracket mounting flange and the second bracket mounting flange define a gap configured to receive an enclosure of the transformer in the assembled configuration.

13. The transformer assembly of claim 8, comprising a fastener configured to insert through the first mounting feature, the second mounting feature, and into a component of the HVAC system to mount the fuse block mounting bracket and the transformer to the component at the common mounting location.

14. The transformer assembly of claim 8, wherein the fuse block includes a slot, the transformer includes a core, the transformer assembly includes a fuse configured to be inserted into the slot, and the fuse is configured to electrically couple to the core in the assembled configuration.

15. The transformer assembly of claim 8, wherein the second mounting feature comprises an oblong shape such that the second mounting feature is configured to align with a third mounting feature of an additional transformer mounting flange separately from aligning with the first mounting feature of the transformer mounting flange, and a first position of the second mounting feature aligned relative to the first mounting feature is different than a second position of the second mounting feature aligned relative to the third mounting feature.

16. The fuse block mounting bracket of claim 8, wherein the mounting panel comprises a receptacle configured to receive a fastener to mount the fuse block to the mounting panel.

17. The fuse block mounting bracket of claim 16, wherein the receptacle comprises tubular extensions configured to receive the fastener and offset the fastener from the transformer.

18. A fuse block mounting bracket for a heating, ventilation, and/or air conditioning (HVAC) system, comprising:

a mounting flange configured to engage with a transformer mounting flange, wherein the mounting flange has a first hole configured to align with a second hole of the transformer mounting flange and configured to receive a fastener to mount the fuse block mounting bracket to a control panel;

a support flange extending transversely from the mounting flange; and a mounting panel extending transversely from the support flange, wherein the mounting panel is configured to couple to and support a fuse block of the HVAC system.

19. The fuse block mounting bracket of claim 18, comprising the fastener, wherein the fastener is configured to extend through the first hole, through the second hole, and into the control panel to mount the fuse block mounting bracket and a transformer having the transformer mounting flange to the control panel.

20. The fuse block mounting bracket of claim 18, wherein the mounting panel comprises a receptacle configured to receive an additional fastener to mount the fuse block to the fuse block mounting bracket such that the additional fastener is offset from a transformer having the transformer mounting flange.

21. The fuse block mounting bracket of claim 20, wherein the receptacle is configured to receive the additional fastener to mount the fuse block to the fuse block mounting bracket such that the fuse block is offset from the mounting panel.

22. The fuse block mounting bracket of claim 18, wherein the support flange comprises an internal cutout formed between edges of the support flange.

23. The fuse block mounting bracket of claim 18, wherein the fuse block mounting bracket has a C-shaped configuration.

24. The fuse block mounting bracket of claim 18, comprising a chamfer extending between the mounting flange and the support flange.

* * * * *